US012065886B2

(12) United States Patent
Chen

(10) Patent No.: US 12,065,886 B2
(45) Date of Patent: Aug. 20, 2024

(54) SHAPED CUTTER WITH MULTIPLE RADIAL RIDGE SETS

(71) Applicant: Halliburton Energy Services, Inc., Houston, TX (US)

(72) Inventor: Shilin Chen, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 22 days.

(21) Appl. No.: 17/956,671

(22) Filed: Sep. 29, 2022

(65) Prior Publication Data

US 2024/0110448 A1 Apr. 4, 2024

(51) Int. Cl.
*E21B 10/567* (2006.01)
*E21B 10/573* (2006.01)

(52) U.S. Cl.
CPC ..... *E21B 10/5673* (2013.01); *E21B 10/5735* (2013.01)

(58) Field of Classification Search
CPC .. E21B 10/55; E21B 10/5673; E21B 10/5676; E21B 10/5735; E21B 10/46
See application file for complete search history.

(56) References Cited

U.S. PATENT DOCUMENTS 4,984,642 A * 1/1991 Renard ..... E21B 10/5673 175/430
5,172,778 A * 12/1992 Tibbitts ..... E21B 10/5673 175/420.1
8,025,107 B2 9/2011 Drivdahl et al.
8,327,956 B2 12/2012 Drews et al.
8,833,492 B2 9/2014 Durairajan et al.
8,851,206 B2 10/2014 Patel
10,125,552 B2 11/2018 Zhao et al.
(Continued)

FOREIGN PATENT DOCUMENTS

WO 2007127680 11/2007
WO 2021041753 3/2021

OTHER PUBLICATIONS

Xie, Dou; Huang, Zhiqiang; Yan, Yuqi; Ma, Yachao; Yuan, Yuan (2020). Application of an innovative ridge-ladder-shaped polycrystalline diamond compact cutter to reduce vibration and improve drilling speed. Science Progress, 103(3), 003685042093097.
(Continued)

*Primary Examiner* — David Carroll
(74) *Attorney, Agent, or Firm* — Michael Jenney; C. Tumey Law Group PLLC

(57) ABSTRACT

Various shaped cutters are disclosed for use on a drill bit or other wellbore forming tool. In one aspect, the shaped cutter includes a plurality of radial ridge sets. Each radial ridge set includes a plurality of ridges radially extending along the cutting table between a periphery of the cutting table and the cutter axis. The cutter may be positioned on the drill bit with one of the radial ridge sets exposed to the formation so the ridges may generate multiple cracks in the formation while drilling. After the current radial ridge set becomes worn, the cutter may be repositioned on the drill bit to expose another one of the radial ridge sets, such as during a repair, refurbish, or maintenance operation. The plurality of ridges may also exploit vibrations in the drill string to enhance rock failure.

18 Claims, 6 Drawing Sheets

(56) References Cited

U.S. PATENT DOCUMENTS

| | | | | |
|---|---|---|---|---|
| 10,399,206 | B1 * | 9/2019 | Mortensen | C22C 1/04 |
| 11,098,532 | B2 | 8/2021 | Gan et al. | |
| 11,215,012 | B2 | 1/2022 | Chen et al. | |
| 2011/0031036 | A1 * | 2/2011 | Patel | E21B 10/52 175/430 |
| 2019/0242192 | A1 * | 8/2019 | Bellin | E21B 10/5735 |
| 2019/0338599 | A1 * | 11/2019 | Bellin | E21B 10/55 |
| 2019/0376346 | A1 * | 12/2019 | Vijayabalan | E21B 10/46 |
| 2020/0018122 | A1 * | 1/2020 | Keller | E21B 10/55 |
| 2020/0347680 | A1 | 11/2020 | Tian et al. | |
| 2022/0003046 | A1 | 1/2022 | Yu et al. | |

OTHER PUBLICATIONS

Development and Verification of Triple-Ridge-Shaped Cutter for PDC Bits, Shao, et al., SPE Journal, 2022.

* cited by examiner

SHAPED CUTTER WITH MULTIPLE RADIAL RIDGE SETS

BACKGROUND

Wells are constructed in subterranean formations in an effort to extract hydrocarbon fluids such as oil and gas. A wellbore may be drilled with a rotary drill bit mounted at the lower end of a drill string. The drill string is assembled at the surface of a wellsite by progressively adding lengths of tubular drilling pipe to reach a desired depth. The drill bit is rotated by rotating the entire drill string from the surface of the well site and/or by rotating the drill bit with a downhole motor incorporated into a bottomhole assembly (BHA) of the drill string. As the drill bit rotates against the formation, cutters on the drill bit disintegrate the formation in proximity to the drill bit. Drilling fluid ("mud") is circulated through the drill string and the annulus between the drill string and the wellbore to lubricate the drill bit and remove cuttings and other debris to surface.

Rotary drill bits are generally categorized as fixed cutter (FC) bits having discrete cutters secured to a bit body at fixed positions (i.e., fixed cutters), roller cone (RC) bits having rolling cutting structures (i.e., roller cones), or hybrid bits comprising both fixed cutters and rolling cutting structures. A fixed cutter is typically secured to the bit body with the cutting table at a particular orientation and position, thereby exposing some portion of the cutting table to the formation. A fixed cutter traditionally has a cylindrical overall shape with a round, flat cutting table. However, as diamond manufacturing continues to improve, more nuanced cutting table shapes continue to be developed that provide various technical advantages.

BRIEF DESCRIPTION OF THE DRAWINGS

These drawings illustrate certain aspects of some examples of the present disclosure and should not be used to limit or define the disclosure.

DETAILED DESCRIPTION

Various shaped cutters are disclosed for use on a drill bit or other wellbore forming tool. The shaped cutters may be fixed cutters, formed as a polycrystalline diamond compact (PDC) utilizing one or more high-pressure, high-temperature press cycle. The design of the disclosed shaped cutter includes various functional aspects to enhance rock removal while drilling. The shaped cutter may cut rock by shearing, and by virtue of its shape, may also enhance other rock failure modes, including but not limited to indentation, impacting, scraping and grinding. In one aspect, the shaped cutter includes a plurality of radial ridge sets. Each radial ridge set includes a plurality of ridges radially extending along the cutting table between a periphery of the cutting table and the cutter axis. The cutter may be positioned on the drill bit with one of the radial ridge sets exposed to the formation so the ridges may generate multiple cracks in the formation while drilling. After the current radial ridge set becomes worn, the cutter may be repositioned on the drill bit to expose another one of the radial ridge sets, such as during a repair, refurbish, or maintenance operation. The cutter geometry may also modify a back rake angle for the cutter engaging the formation as compared with the back rake angle of a conventional cylindrical cutter at the same relative orientation on the bit body.

The shape of the disclosed cutters may also make productive use of the presence of vibrations in the drill string, which may include both torsional and axial vibration components. Aspects of the disclosed cutter designs were conceived, in part, on a recognition that a PDC bit has almost always some type of vibration in drilling, especially in relatively hard formations. Vibration in a cutting direction may help the teeth to generate more cracks in the formation in front of the radial ridges. Energy may be distributed over the multiple cracks to increase a frequency and/or reduce an amplitude of a vibration frequency while drilling. Torsional vibrations propagating to a drill bit may be used to enhance cutting with the use of a non-planar (e.g., tapered) cutter surface at locations where a conventional cutter may otherwise have a planar surface.

Figure 1:
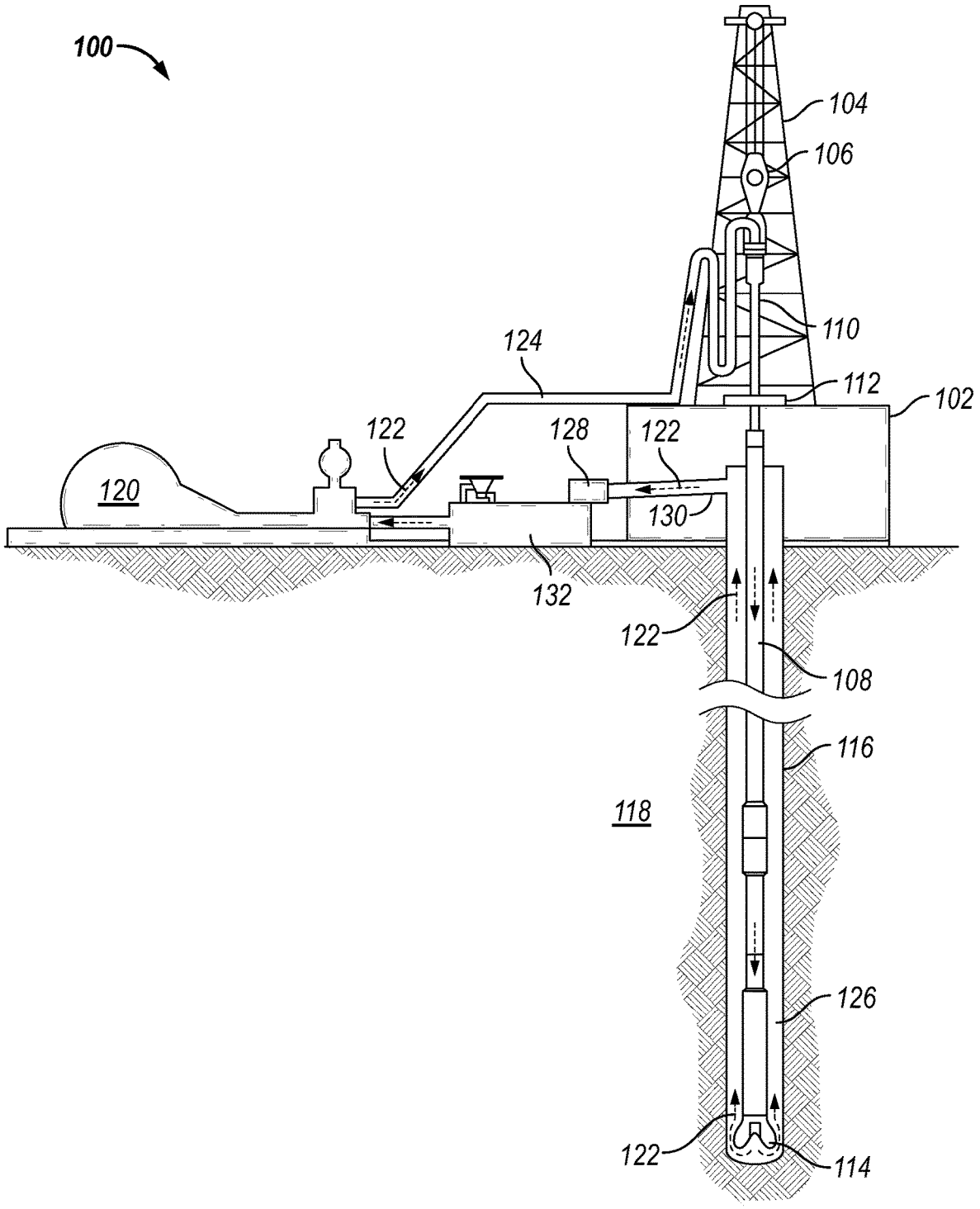
FIG. 1 is an elevation, partially cross-sectional view of a representative well site at which a wellbore may be formed by drilling and other operations.

FIG. 1 is an elevation, partially cross-sectional view of a representative well site at which a wellbore may be formed by drilling and other operations. While FIG. 1 generally depicts land-based drilling, the principles described herein are applicable to subsea drilling operations that employ floating or sea-based platforms and rigs, without departing from the scope of the disclosure. As illustrated, a drilling rig 100 may include a drilling platform 102 that supports a derrick 104 having a traveling block 106 for raising and lowering a drill string 108. The drill string 108 may include, but is not limited to, drill pipe and coiled tubing, as generally known to those skilled in the art. A kelly 110 supports the drill string 108 as it is lowered through a rotary table 112. A rotary drill bit 114 is attached to the distal end of the drill string 108 and may be rotated by via rotation of the drill string 108 from the well surface and/or a downhole motor. The drill bit 114 is a wellbore forming tool that is used to initially form a wellbore 116 in a subterranean formation 118. Other wellbore forming tools may be included on the drill string for use in certain drilling operations, such as one or more hole opener and/or reamer to selectively widen a portion of the wellbore 116, or a coring bit used to obtain and retrieve a sample of the formation for analysis.

The drill bit 114 may be a fixed-cutter or hybrid drill bit having one or more fixed cutters, including one or more shaped cutters as disclosed herein to enhance rock removal. A pump 120 (e.g., a mud pump) circulates drilling fluid 122 through a feed pipe 124 and to the kelly 110, which conveys the drilling fluid 122 downhole through the interior of the drill string 108 and through one or more orifices in the drill bit 114. The drilling fluid 122 is then circulated back to the surface via an annulus 126 defined between the drill string 108 and the walls of the wellbore 116. At the surface, the recirculated or spent drilling fluid 122 exits the annulus 126 and may be conveyed to one or more fluid processing unit(s) 128 via an interconnecting flow line 130. After passing through the fluid processing unit(s) 128, a "cleaned" drilling fluid 122 is deposited into a nearby retention pit 132 (i.e., a mud pit). While illustrated as being arranged at the outlet of the wellbore 116 via the annulus 126, those skilled in the art will readily appreciate that the fluid processing unit(s) 128 may be arranged at any other location in the drilling rig 100 to facilitate its proper function, without departing from the scope of the scope of the disclosure.

Figure 2:
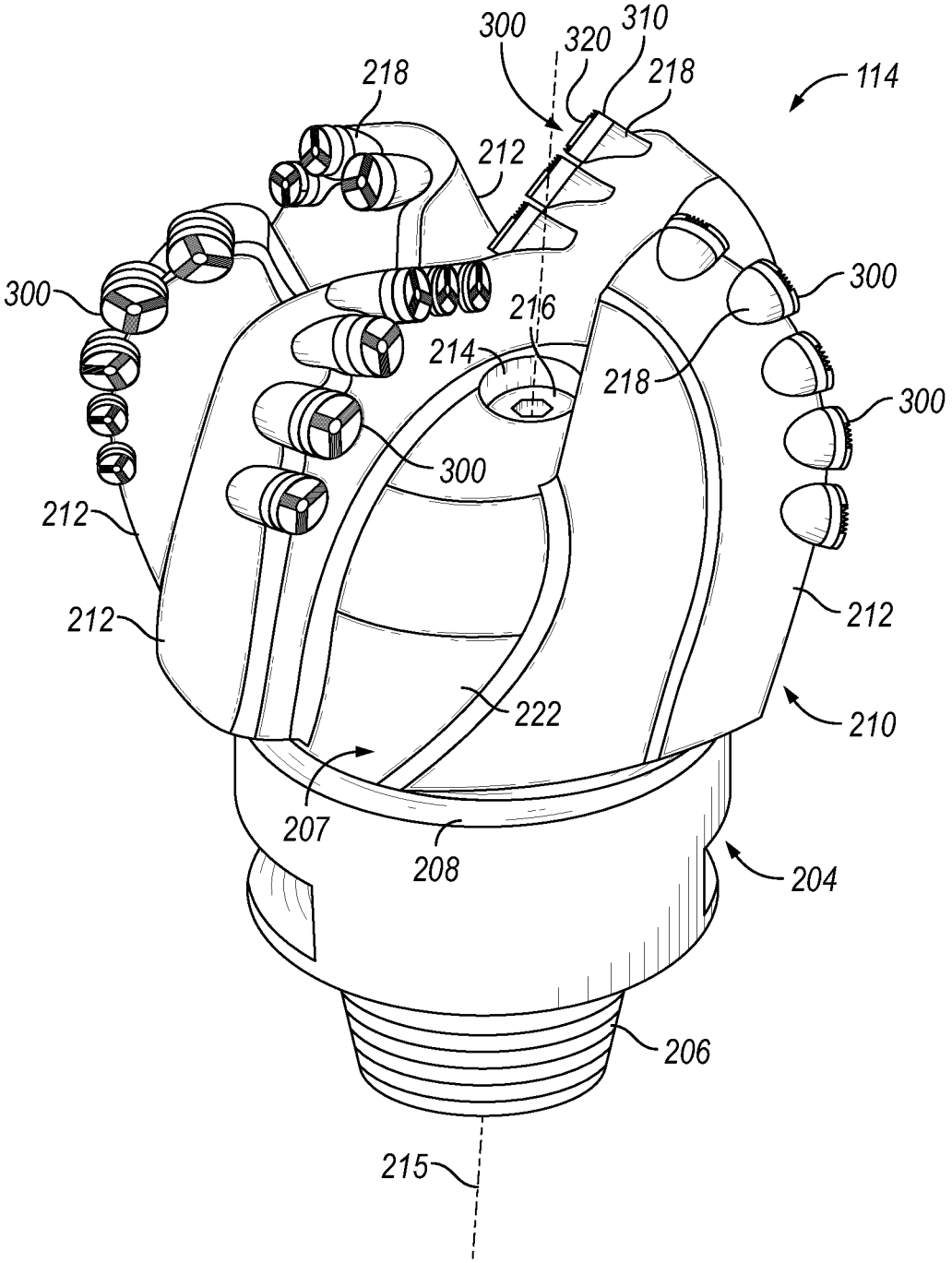
FIG. 2 is a perspective view of a drill bit as an example of a wellbore forming tool that may use the disclosed shaped cutters.

FIG. 2 is a perspective view of the drill bit 114 as an example of a wellbore forming tool that may employ shaped cutters and other aspects of the present disclosure. The drill bit 114 includes a rigid bit body 210 to which a plurality of fixed cutters may be secured, of which one or more may be a disclosed shaped cutter 300. In some embodiments, the bit body 210 may be formed by a metal-matrix composite, such as tungsten carbide reinforcing particles dispersed in a binder alloy. The bit body 210 includes a plurality of blades 212 formed on the exterior of the bit body 210. The blades 212 may be spaced from each other to form fluid flow paths or junk slots 222 therebetween. A plurality of cutter pockets 218 are formed on the blades 212 to receive cutters at predetermined positions. As illustrated, all of the cutters are shaped cutters 300 according to this disclosure. However, other embodiments may include one or more of the shaped cutters 300 in combination with other cutters, such as conventional round/flat cutters or other cutter shapes. Each shaped cutter 300 includes a substrate 310 and a cutting table 320 secured to the substrate 310. The substrate 310 is received by the respective cutter pocket 218 and secured within the cutter pocket 218 such as by brazing.

The bit body defines a bit axis 215 about which the drill bit 114 may rotate while drilling. The bit axis 215 may coincide at least approximately with a center of mass of the drill bit 114. The bit axis 215 may be generally aligned with an axis of a drill string or other conveyance to which the drill bit 114 is coupled. Drill bits may be connected in any of an unlimited number of ways to a drill string, coiled tubing, or other conveyance to allow for rotation about the bit axis 215. In this example, the drill bit 114 may include a metal shank 204 with a mandrel or metal blank 207 securely attached thereto (e.g., at weld location 208). The metal blank 207 extends into bit body 210. The metal shank 204 includes a threaded connection 206 distal to the metal blank 207 for securing the drill bit 114 to a drill string, which connection may generally align the bit axis 215 with an axis of the drill string or other desired axis of rotation.

While drilling, an axial force such as weight on bit (WOB) may be applied in a direction of the bit axis 215, such that the cutters 300 engage the formation being drilled. Simultaneously, the drill bit 114 is rotated about the bit axis 215 to engage the earthen formation to cut material ("rock") from the formation. The shaped cutters 300 have particular shapes, such as disclosed below in specific examples, that may enhance the removal of rock while drilling. Drilling fluid circulated downhole may lubricate the drill bit 114 and remove the cuttings and other fluid contaminants to the surface, such as generally described above in relation to FIG. 1. A nozzle 216 may be positioned in each nozzle opening 214 and positioned to clear cuttings/chips of formation material from the shaped cutters 300 through evacuation features of the bit 114, including junk slots 222.

Figure 3:
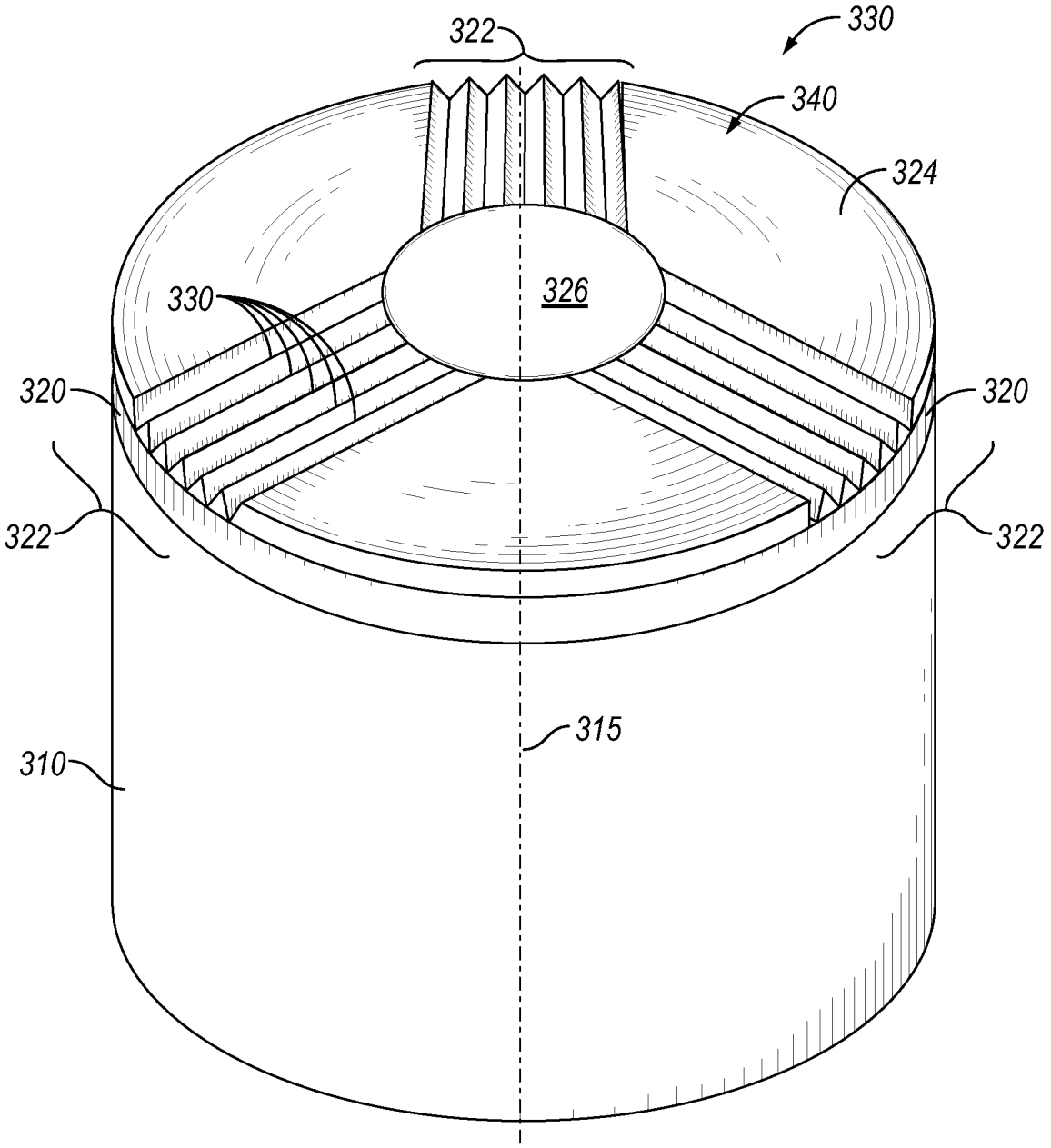
FIG. 3 is a perspective view of a shaped cutter according to an example embodiment having a cutting table with three sets of radial ridge sets.

FIG. 3 is a perspective view of a shaped cutter 300 according to an example embodiment having a cutting table 320 with three sets of radial ridges 300, i.e., three radial ridge sets 322. The cutting table 320 may be formed of a diamond-based material, such as polycrystalline diamond (PCD) comprising diamond particles with diamond-diamond bonds formed under high temperature and pressure. The cutting table 320 is secured to a substrate 310, which may be made of any suitable material such as tungsten carbide (WC) or other carbide material. In some examples, the diamond table 320, or a PCD form or blank thereof, may be simultaneously formed and bonded to the substrate 310 in one or more high-temperature, high-pressure (HTHP) press cycle. In other examples, the diamond table 320, or a PCD form or blank thereof, may be formed separately from the substrate 310 and then bonded to the substrate 310 such as by brazing or welding. The radial ridge sets 322 may be at least partially formed with a mold during the press cycle, with subsequent finishing steps to achieve the final shape. Alternatively, the shaped cutter 300 may initially be formed as a round and/or flat shape and the ridge sets 322 machined such as using electromagnetic discharge machining (EDM).

The shaped cutter 300 may have a generally round overall shape, particularly along the substrate 310 as illustrated. A cutter axis 315 extending through the center of the cutting table 320 may provide a geometrical reference for discussing certain features of the cutting table 320. The cutter axis 315 is typically along a centerline or a center of mass of the shaped cutter 300. The radial ridge sets 322 are circumferentially spaced from one another along a generally circular periphery 324 of the cutting table 320 about the cutter axis 315. Within each radial ridge set 322 are a plurality of radially extending ridges 330, which may be referred to herein as radial ridges or simply as ridges. There are three radial ridge sets 322 with five radial ridges per set 330 in this example, although other embodiments may have a different number of radial ridge sets and ridges per set. The radial ridges 330 each extend radially from the periphery 324 toward the cutter axis 315. Within each radial ridge set 322 the radial ridges 330 are parallel with one another as they extend radially toward the bit axis 315. The radial ridges 330 all terminate at a generally circular ridge termination region 326 on a cutting face 340, which is generally a convex, non-planar surface. In this example. The shaped cutter 330 may be positioned on a drill bit with one of the radial ridge sets 322 exposed to the formation for cutting. The multiple radial ridges 330 per set may generate multiple cracks in the formation and distribute energy over the multiple cracks to increase a frequency and/or reduce an amplitude of a vibration frequency while drilling. The multiple radial ridge sets 322 may be functionally redundant in that as one radial ridge set 322 is worn down the shaped cutter 300 may be repositioned to expose another one of the radial ridge sets 322 to the formation. For example, the shaped cutter 300 may be removed from the cutter pocket on a drill bit, repositioned about its bit axis 315, and re-attached to the cutter pocket on the drill bit.

Except as otherwise noted, the geometry and proportions of shaped cutter features illustrated are exemplary and not necessarily to scale. For instance, even while conforming to the general parameters of three radial ridge sets and five radial ridges per set represented by FIG. 3, geometrical aspects of the cutting table 320 such as a concavity or convexity and the geometry of the individual radial ridges 330 such as length and height may vary. Subsequent figures provide non-limiting examples of various geometrical features that are within the scope of this disclosure.

Figure 4:
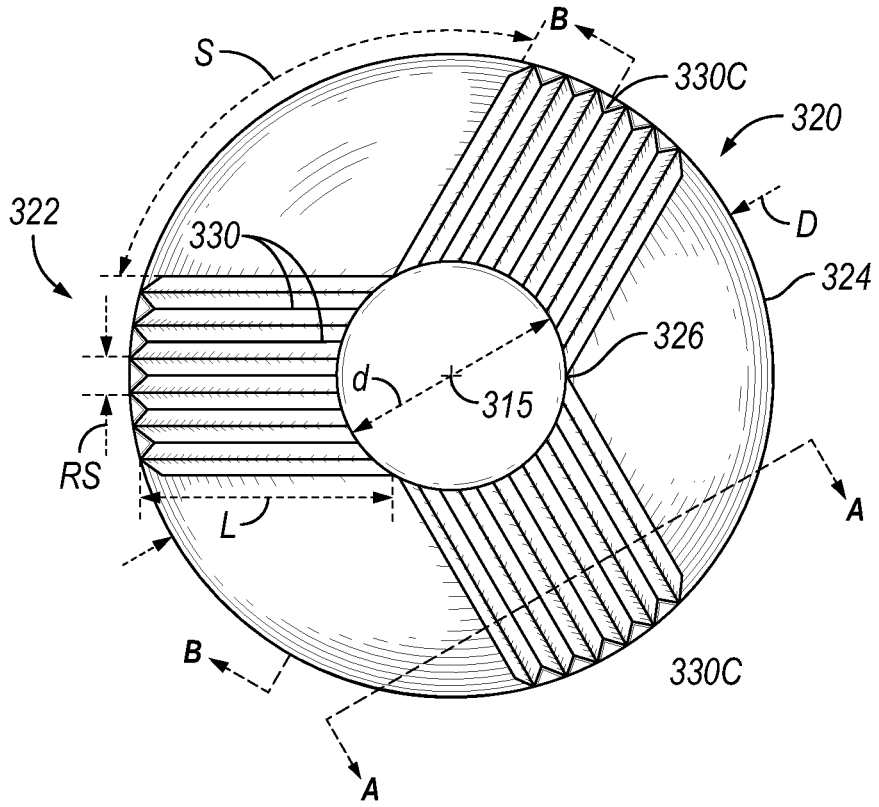
FIG. 4 is a plan view of the cutting table of FIG. 3.

FIG. 4 is a plan view of the cutting table 320 of FIG. 3. Each radial ridge set 322 has a ridge spacing "RS" between adjacent ridges 330 and a set spacing "S" at the periphery 324 between adjacent radial ridge sets 322. Generally, the set spacing S is greater than the ridge spacing RS in each set. The radial ridge sets 322 may be equally spaced circumferentially, such that the set spacing S between any two adjacent ridges sets 322 is equal. Although there are three radial ridge sets 322 with five ridges 330 per set in this example, other embodiments may be constructed with at least three radial ridge sets and wherein each radial ridge set includes at least three of the radial ridges per radial ridge set. The ridge spacing RS between adjacent ridges 330 in each radial ridge set is optionally equal, as shown in this example. The ridge spacing RS in each radial ridge set 322 is also optionally equal to the ridge spacing RS in all of the other radial ridge sets 322, as also shown in this example.

Every ridge 330 extends from the periphery 324 and terminates at the circular termination region 326, which is centered about the cutter axis 315. Optionally, the circular ridge termination region 326 has a diameter "d" of between 25% and 50% of a cutting table diameter "D". Because the ridges 330 in each ridge set 322 are equally spaced from each other, and are parallel to one another in a radial direction, only a center ridge specifically identified at 330C in each set 322 is aligned with the cutter axis 315. The other ridges 330 in each ridge set 322 are laterally spaced from the center ridge 330C.

Each ridge 330 has a ridge length "L." The ridge length L of the center ridge 330C is the shortest in each ridge set 322. The ridge length L of other ridges 330 in the ridge set 322 are longer than the center ridge 330C because they traverse a greater distance along the cutting table 320 from the periphery 324 to where they terminate at the circular termination region 326. A ridge height into the page of FIG. 4 is further explained below with respect to FIG. 9. The ridge height may be constant along the entire ridge length L of each ridge 330. In some cases, the ridge height may vary along at least a portion of its ridge length L, such as if the ridges 330 transition at their ends where they meet the periphery 324 or the circular ridge termination region 326. However, the ridge height of each ridge 330 is preferably constant along a majority of its length, such as at least 90% of its ridge length L. Also, the ridge heights of the ridges 330 in each ridge set 322 are preferably equal along at least 90% of their ridge lengths, where the ridge heights of the ridges 330 are compared in a plane such as A-A that is perpendicular to the ridges 330.

Figure 5:
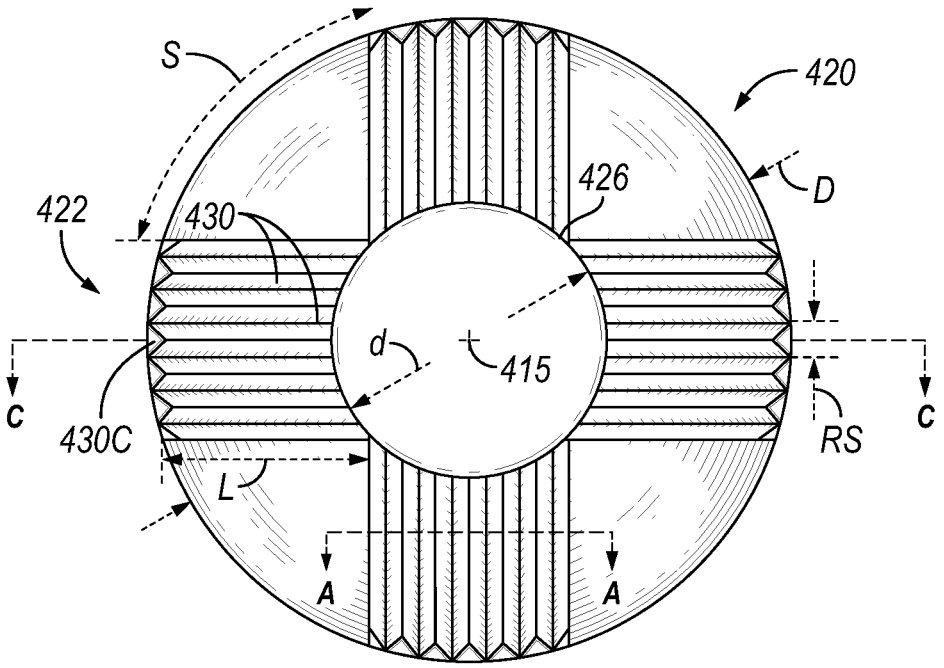
FIG. 5 is a plan view of another cutting table having four radial ridge sets.

FIG. 5 is a plan view of another cutting table 420 having four radial ridge sets 422. Each radial ridge set 422 again has a ridge spacing "RS" between adjacent ridges 430 and a set spacing "S" at the periphery 424 between adjacent radial ridge sets 422. Generally, the set spacing S is greater than the ridge spacing RS in each set. However, because there are four radial ridge sets, the set spacing S in FIG. 5 is less than the set spacing of FIG. 4. The ridge spacing RS between adjacent ridges 430 in each radial ridge set is again equal in this example. The ridge spacing RS in each radial ridge set 422 is also again equal to the ridge spacing RS in all of the other radial ridge sets 422. Also, as in the embodiment of FIG. 4, every ridge 430 extends from the periphery 424 and terminates at the circular termination region 426, which is centered about the cutter axis 415. Because the ridges 430 in each ridge set 422 are equally spaced from each other, and are parallel to one another in a radial direction, only a center ridge specifically identified at 430C in each set 422 is aligned with the cutter axis 415. The other ridges 430 in each ridge set 422 are spaced from the center ridge 430C. Each ridge 420 has a ridge length L. The length L of the center ridge 430C is the shortest in each ridge set 422. The length L of other ridges 430 in the ridge set are longer because they have a greater distance from the periphery 424 to where they terminate at the circular termination region 426. Optionally, the circular ridge termination region has a diameter "d" of between 25% and 50% of a cutting table diameter "D".

Because cutter geometry may vary within the disclosed parameters and constraints, a range of possible ridge and cutting face geometries are possible within the general parameters described in the examples of FIGS. 3 and 4. FIGS. 6-10 provide examples of various cross-sections and other views for purpose of discussing optional cutter geometry and features, such as concave and/or convex cutter face geometries as well as certain ridge dimensions and profiles.

Figure 6:
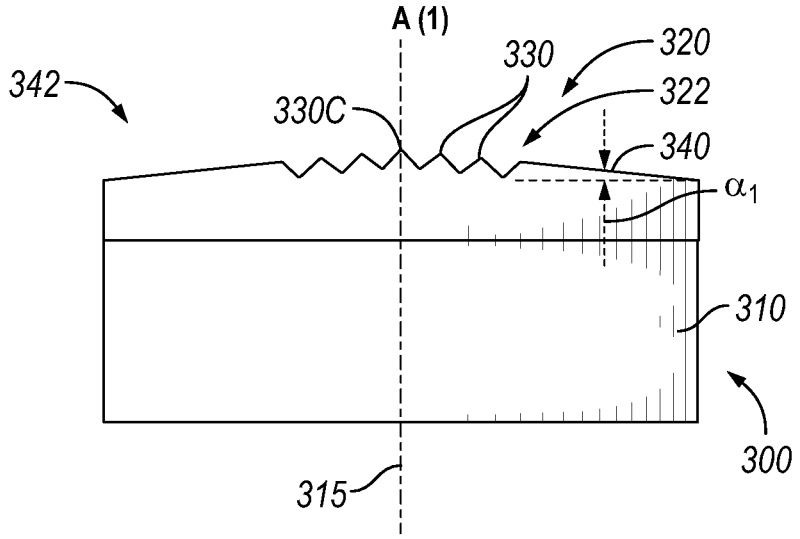
FIG. 6 is an example of a cross-section taken along a first plane A-A through one of the radial ridge sets of FIG. 4.

FIG. 6 is an example of a cross-section A(1) taken along a first plane A-A through one of the radial ridge sets of FIG. 4. The first plane A-A is parallel with the cutter axis 315 and perpendicular through the ridges 330 of the radial ridge sets. The ridges 330 extend radially, which is in a direction into the page of FIG. 6. The ridges 330 point vertically upwardly in a direction aligned with the cutter axis 315. The central ridge 330C is aligned with the cutter axis 315 in this view, with two ridges 330 in the ridge set 322 to the left of the central ridge 330C and two ridges 330 in the ridge set 322 to the right of the central ridge 330C. In the first plane A-A, the cutting table 320 has a cutting face 340 with a convex profile 342 in an axial direction away from the substrate 310. The convex profile 342 in the plane A-A may be referred to non-exclusively as the first convex profile. The convex profile 342 defines a first taper angle "at" which is optionally within a range of between 5 and 15 degrees. The ridges 330 are arranged to generally follow the convex profile 342 of the cutting face 340, such that the central ridge 330C is higher than the ridges 330 on either side of the central ridge 330C. However, the ridges 330 are at least partially recessed below the convex profile 342 of the cutting face 340, such that the ridges peak at or near the convex profile 342. Further details of one of the ridges 330 are discussed further below in reference to the schematic diagram of FIG. 9.

Figure 7:
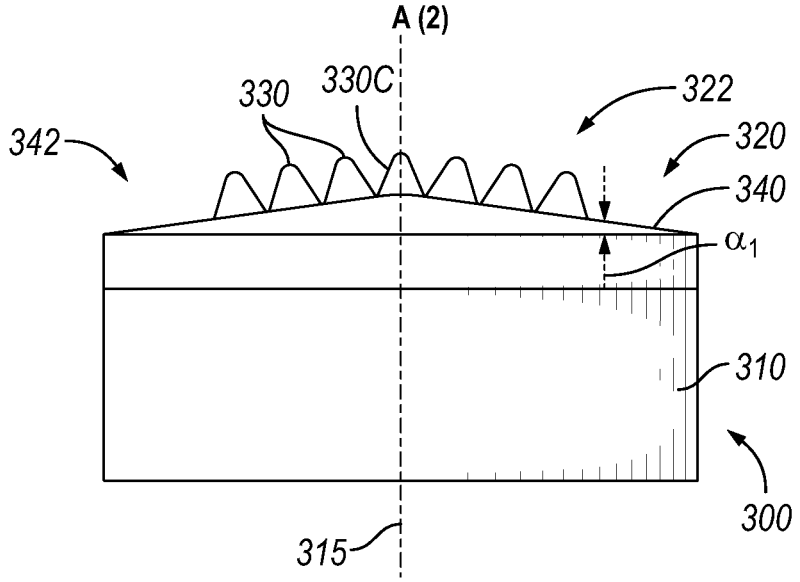
FIG. 7 is an alternative example of a cross-section through a radial ridge set having seven ridges.

FIG. 7 is another, alternative example of a cross-section A(2) through an example of a radial ridge set having seven ridges 330. The ridges 330 again extend radially in a direction into the page and point vertically upwardly in a direction aligned with the cutter axis 315. The central ridge 330C is aligned with the cutter axis 315 in this view, with three ridges 330 in the ridge set 322 to the left of the central ridge 330C and three ridges 330 in the ridge set 322 to the right of the central ridge 330C. The cutting table 320 has a convex profile 342 in this plane, in an axial direction away from the substrate 310. However, the ridges 330 extend upwardly from the convex profile 342 rather than being recessed with respect to the cutting face 340. The convex profile 342 again has taper angle "$\alpha_1$" which is optionally within a range of between 5 and 15 degrees. The ridges 330 are arranged to generally follow the convex profile 342, such that the central ridge 330C is higher than the ridges 330 on either side of the central ridge 330C.

Figure 8:
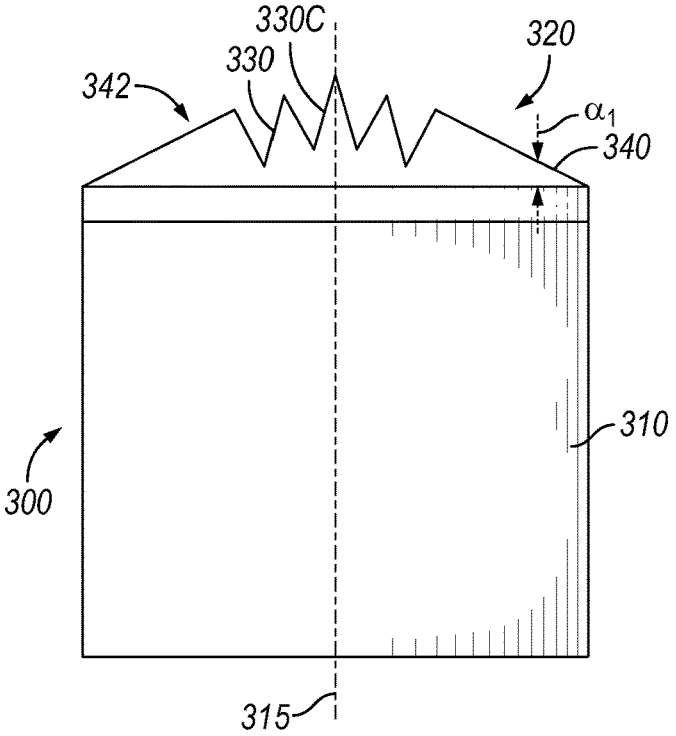
FIG. 8 is another alternative example of a cross-section through a radial ridge set having three ridges.

FIG. 8 is another, alternative example of a cross-section A(3) through an example of a radial ridge set having three ridges 330. The ridges 330 again extend radially in a direction into the page and point vertically upwardly in a direction aligned with the cutter axis 315. The ridges 330 may be taller and sharper than ridges in the other cross-section examples. The central ridge 330C is aligned with the cutter axis 315 in this view, with only one ridge 330 in the ridge set 322 to the left of the central ridge 330C and one ridge 330 in the ridge set 322 to the right of the central ridge 330C. The cutting table 320 once again has a convex profile 342 in this plane, in an axial direction away from the substrate 310. The ridges 330 are at least partially recessed below the convex profile 342, peaking at or near the convex profile 342. The convex profile 342 again defines taper angle "$\alpha_1$" which is optionally within a range of between 5 and 15 degrees. The ridges 330 are arranged to generally follow the convex profile 342, such that the central ridge 330C is higher than the ridges 330 on either side of the central ridge 330C.

Figure 9:
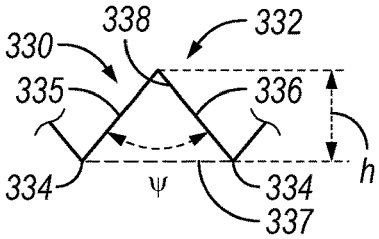
FIG. 9 is a schematic cross-sectional view of one of the ridges enlarged for detail.

FIG. 9 is a schematic, cross-sectional view of one of the ridges 330 enlarged for detail. The ridge 330 comprises a peak 332 and a valley 334 on each side of the peak 332, and opposing surface pairs 335, 336 intersecting at the respective peak 332 at a ridge angle "ψ" that is preferably within a range of 30 to 120 degrees. Adjacent peaks (not shown in FIG. 9) on either side of the peak 332 may have a common valley 334 therebetween. The peak 332 may be pointed and relatively sharp, or may have a rounded or chamfered region 338 in a range of between 0.2 and 2.0 mm. The ridge 330 has a ridge height "h" as measured from the peak 338 to the valley 334 on either side of that ridge 334. The ridge 330 is symmetrical in this example, forming an isosceles triangle in the plane of the page with the peak 332 and pair of valleys 334. Thus, in FIG. 9, the ridge height h is perpendicular to a geometrically constructed base 337 of the isosceles triangle. In other embodiments the valley 334 on one side may be lower than the valley 334 on the other side, such as to follow the profile of convex cutting face. In that scenario, the ridge height h may be defined perpendicular to a base of a triangle defined between the peak 332 and the two valleys 334. As discussed above in reference to FIG. 4, the ridge height h of each ridge 330 may be constant along at least 90% of its length and the ridges 330 in each ridge set 322 may be equal along at least 90% of their ridge lengths.

Figure 10:
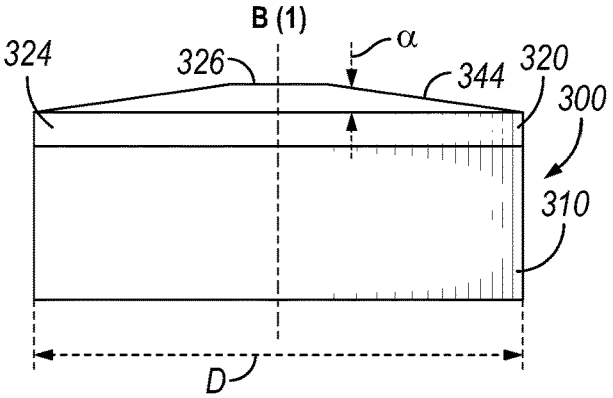
FIG. 10 is an example of a convex cross-section taken along a second plane parallel with the ridges in a ridge set.

FIG. 10 is an example of a convex cross-section B(1) taken along a second plane parallel with the ridges in a ridge set (ninety degrees from the plane of FIGS. 6-8). The plane may represent, for example, the plane B-B of FIG. 4 or the plane C-C of FIG. 5. The cutting face 340 has a second convex profile 344 in this plane B-B, in an axial direction away from the substrate. The second convex profile 344 defines a second taper angle α that is preferably also in a range of between 5 and 15 degrees. The ridges 330 (see, e.g., FIGS. 4 and 5) in the ridge set may each follow the second convex profile 342 along their ridge lengths, sloping upwardly from the periphery 324 of the cutting table 320 to the circular ridge termination region 326.

Therefore, a shaped cutter is disclosed along with a drill bit and a drilling method utilizing such a shaped cutter. The shaped cutter may include a plurality of radial ridge sets, each having a plurality of ridges radially extending along the cutting table between a periphery of the cutting table and the cutter axis. The cutter may be positioned on the drill bit with one of the radial ridge sets exposed to the formation so the ridges may generate multiple cracks in the formation while drilling. The shaped cutter, drill bit, and drilling method may include any combination of features including but not limited to those in the following examples.

Example 1. A shaped cutter for a fixed cutter drill bit, the shaped cutter comprising: a substrate having a proximal end and a distal end and defining a cutter axis passing through the proximal and distal ends; and a cutting table secured to the proximal end of the substrate at a cutter-substrate interface, the cutting table having a plurality of radial ridge sets, each radial ridge set comprising a plurality of ridges radially extending from a periphery of the cutting table toward the cutter axis, with a ridge spacing between adjacent ridges in each ridge set and a set spacing at the periphery between adjacent radial ridge sets, wherein the set spacing is greater than the ridge spacing.

Example 2. The shaped cutter of Example 1, wherein the cutting table has a total of three or four of the radial ridge sets.

Example 3. The shaped cutter of Example 1 or 2, wherein each radial ridge set includes at least three of the radial ridges.

Example 4. The shaped cutter of any of Examples 1 to 3, wherein the cutting table includes at least three of the radial ridge sets with at least three of the radial ridges per radial ridge set.

Example 5. The shaped cutter of any of Examples 1 to 4, wherein the ridge spacing between adjacent ridges in each radial ridge set is equal.

Example 6. The shaped cutter of Example 5, wherein the ridge spacing in each radial ridge set is equal to the ridge spacing in all of the other radial ridge sets.

Example 7. The shaped cutter of any of Examples 1 to 6, wherein the cutting table comprises a circular ridge termination region centered about the cutter axis, wherein each ridge terminates at the circular ridge termination region.

Example 8. The shaped cutter of Example 7, wherein the circular ridge termination region has a diameter of between 25% and 50% of a cutting table diameter.

Example 9. The shaped cutter of Example 7 or 8, wherein the ridges all slope upwardly from the periphery of the cutting table to the circular ridge termination region.

Example 10. The shaped cutter of any of Examples 7 to 9, wherein the circular ridge termination region is generally planar and orthogonal to the cutter axis.

Example 11. The shaped cutter of any of Examples 1 to 10, wherein a first cross-section of the cutting table taken along a first plane parallel with the cutter axis and perpendicular through the ridges of any of the radial ridge sets has a first convex profile in an axial direction away from the substrate.

Example 12. The shaped cutter of Example 11, wherein the first convex profile defines a first taper angle of between 5 and 15 degrees.

Example 13. The shaped cutter of any of Examples 1 to 12, wherein a second cross-section of the cutting table taken along a second plane through one of the ridge sets and parallel with the ridges in the one of the ridge sets has a second convex profile in an axial direction away from the substrate.

Example 14. The shaped cutter of Example 13, wherein the second convex profile defines a second taper angle of between 5 and 15 degrees.

Example 15. The shaped cutter of any of Examples 1 to 14, wherein each ridge has a ridge height as measured from a peak to a valley of that ridge, and wherein the ridge height of each ridge is constant along at least 90% of that ridge.

Example 16. The shaped cutter of Example 15, wherein the ridges in each ridge set have a ridge length from the periphery of the cutting table toward the cutter axis and the ridge heights of the ridges in each ridge set are equal along at least 90% of their ridge lengths.

Example 17. The shaped cutter of Example 15 or 16, wherein each ridge includes opposing surface pairs intersecting at the respective peak at a ridge angle of between thirty to one hundred twenty degrees.

Example 18. A drill bit comprising: a bit body comprising one or more blades each having one or more cutter pockets;

one or more shaped cutters disposed in a respective one of the cutter pockets, each shaped cutter comprising a substrate having a proximal end and a distal end and defining a cutter axis passing through the proximal and distal ends, and a cutting table secured to the proximal end of the substrate at a cutter-substrate interface, the cutting table having a plurality of radial ridge sets, each radial ridge set comprising a plurality of ridges radially extending from a periphery of the cutting table toward the cutter axis, with a ridge spacing between adjacent ridges in each ridge set and a set spacing at the periphery between adjacent radial ridge sets, wherein the set spacing is greater than the ridge spacing.

Example 19. The drill bit of Example 18, wherein the cutting table has a total of three or four of the radial ridge sets.

Example 20. A drilling method, comprising: rotating a drill bit about a bit axis, the drill bit comprising a bit body with one or more blades each having one or more cutter pockets and one or more shaped cutters secured in a respective one of the cutter pockets, each shaped cutter comprising a substrate having a proximal end and a distal end and defining a cutter axis passing through the proximal and distal ends, and a cutting table secured to the proximal end of the substrate at a cutter-substrate interface, the cutting table having a cutting end comprising a plurality of peripheral cutting teeth circumferentially arranged along a periphery of the cutting table equidistant from the cutter axis, and an open region spanning a portion of the cutting table radially inward of the peripheral cutting teeth; and axially engaging a formation to be drilled with the drill bit while rotating the drill bit.

It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A shaped cutter for a fixed cutter drill bit, the shaped cutter comprising:

a substrate having a proximal end and a distal end and defining a cutter axis passing through the proximal and distal ends; and a cutting table secured to the proximal end of the substrate at a cutter-substrate interface, the cutting table having a plurality of radial ridge sets, each radial ridge set comprising a plurality of ridges radially extending from a periphery of the cutting table toward the cutter axis, with a ridge spacing between adjacent ridges in each ridge set and a set spacing at the periphery between adjacent radial ridge sets, wherein the set spacing is greater than the ridge spacing, wherein the cutting table has a total of three or four of the radial ridge sets.

2. The shaped cutter of claim 1, wherein each radial ridge set includes at least three of the radial ridges.

3. The shaped cutter of claim 1, wherein the cutting table includes at least three of the radial ridge sets with at least three of the radial ridges per radial ridge set.

4. The shaped cutter of claim 1, wherein the ridge spacing between adjacent ridges in each radial ridge set is equal.

5. The shaped cutter of claim 4, wherein the ridge spacing in each radial ridge set is equal to the ridge spacing in all of the other radial ridge sets.

6. The shaped cutter of claim 1, wherein the cutting table comprises a circular ridge termination region centered about the cutter axis, wherein each ridge terminates at the circular ridge termination region.

7. A shaped cutter for a fixed cutter drill bit, the shaped cutter comprising:

a substrate having a proximal end and a distal end and defining a cutter axis passing through the proximal and distal ends; and a cutting table secured to the proximal end of the substrate at a cutter-substrate interface, the cutting table having a plurality of radial ridge sets, each radial ridge set comprising a plurality of ridges radially extending from a periphery of the cutting table toward the cutter axis, with a ridge spacing between adjacent ridges in each ridge set and a set spacing at the periphery between adjacent radial ridge sets, wherein the set spacing is greater than the ridge spacing, wherein the cutting table comprises a circular ridge termination region centered about the cutter axis, wherein each ridge terminates at the circular ridge termination region, and wherein the circular ridge termination region has a diameter of between 25% and 50% of a cutting table diameter.

8. A shaped cutter for a fixed cutter drill bit, the shaped cutter comprising:

a substrate having a proximal end and a distal end and defining a cutter axis passing through the proximal and distal ends; and a cutting table secured to the proximal end of the substrate at a cutter-substrate interface, the cutting table having a plurality of radial ridge sets, each radial ridge set comprising a plurality of ridges radially extending from a periphery of the cutting table toward the cutter axis, with a ridge spacing between adjacent ridges in each ridge set and a set spacing at the periphery between adjacent radial ridge sets, wherein the set spacing is greater than the ridge spacing, wherein the cutting table comprises a circular ridge termination region centered about the cutter axis, wherein each ridge terminates at the circular ridge termination region, wherein the ridges all slope upwardly from the periphery of the cutting table to the circular ridge termination region.

9. A shaped cutter for a fixed cutter drill bit, the shaped cutter comprising:

a substrate having a proximal end and a distal end and defining a cutter axis passing through the proximal and distal ends; and a cutting table secured to the proximal end of the substrate at a cutter-substrate interface, the cutting table having a plurality of radial ridge sets, each radial ridge set comprising a plurality of ridges radially extending from a periphery of the cutting table toward the cutter axis, with a ridge spacing between adjacent ridges in each ridge set and a set spacing at the periphery between adjacent radial ridge sets, wherein the set spacing is greater than the ridge spacing, wherein the cutting table comprises a circular ridge termination region centered about the cutter axis, wherein each ridge terminates at the circular ridge termination region, and wherein the circular ridge termination region is generally planar and orthogonal to the cutter axis.

10. The shaped cutter of claim 1, wherein a first cross-section of the cutting table taken along a first plane parallel with the cutter axis and perpendicular through the ridges of any of the radial ridge sets has a first convex profile in an axial direction away from the substrate.

11. A shaped cutter for a fixed cutter drill bit, the shaped cutter comprising:

a substrate having a proximal end and a distal end and defining a cutter axis passing through the proximal and distal ends; and a cutting table secured to the proximal end of the substrate at a cutter-substrate interface, the cutting table having a plurality of radial ridge sets, each radial ridge set comprising a plurality of ridges radially extending from a periphery of the cutting table toward the cutter axis, with a ridge spacing between adjacent ridges in each ridge set and a set spacing at the periphery between adjacent radial ridge sets, wherein the set spacing is greater than the ridge spacing, wherein a first cross-section of the cutting table taken along a first plane parallel with the cutter axis and perpendicular through the ridges of any of the radial ridge sets has a first convex profile in an axial direction away from the substrate, and wherein the first convex profile defines a first taper angle of between 5 and 15 degrees.

12. The shaped cutter of claim 10, A shaped cutter for a fixed cutter drill bit, the shaped cutter comprising:

a substrate having a proximal end and a distal end and defining a cutter axis passing through the proximal and distal ends; and a cutting table secured to the proximal end of the substrate at a cutter-substrate interface, the cutting table having a plurality of radial ridge sets, each radial ridge set comprising a plurality of ridges radially extending from a periphery of the cutting table toward the cutter axis, with a ridge spacing between adjacent ridges in each ridge set and a set spacing at the periphery between adjacent radial ridge sets, wherein the set spacing is greater than the ridge spacing, wherein a first cross-section of the cutting table taken along a first plane parallel with the cutter axis and perpendicular through the ridges of any of the radial ridge sets has a first convex profile in an axial direction away from the substrate, and wherein a second cross-section of the cutting table taken along a second plane through one of the ridge sets and parallel with the ridges in the one of the ridge sets has a second convex profile in an axial direction away from the substrate.

13. The shaped cutter of claim 12, wherein the second convex profile defines a second taper angle of between 5 and 15 degrees.

14. The shaped cutter of claim 1, wherein each ridge has a ridge height as measured from a peak to a valley of that ridge, and wherein the ridge height of each ridge is constant along at least 90% of that ridge.

15. The shaped cutter of claim 14, wherein the ridges in each ridge set have a ridge length from the periphery of the cutting table toward the cutter axis and the ridge heights of the ridges in each ridge set are equal along at least 90% of their ridge lengths.

16. A shaped cutter for a fixed cutter drill bit, the shaped cutter comprising:

a substrate having a proximal end and a distal end and defining a cutter axis passing through the proximal and distal ends; and a cutting table secured to the proximal end of the substrate at a cutter-substrate interface, the cutting table having a plurality of radial ridge sets, each radial ridge set comprising a plurality of ridges radially extending from a periphery of the cutting table toward the cutter axis, with a ridge spacing between adjacent ridges in each ridge set and a set spacing at the periphery between adjacent radial ridge sets, wherein the set spacing is greater than the ridge spacing, wherein each ridge has a ridge height as measured from a peak to a valley of that ridge, wherein the ridge height of each ridge is constant along at least 90% of that ridge, and wherein each ridge includes opposing surface pairs intersecting at the respective peak at a ridge angle of between thirty to one hundred twenty degrees.

17. A drill bit comprising:

a bit body comprising one or more blades each having one or more cutter pockets;

one or more shaped cutters disposed in a respective one of the cutter pockets, each shaped cutter comprising a substrate having a proximal end and a distal end and defining a cutter axis passing through the proximal and distal ends, and a cutting table secured to the proximal end of the substrate at a cutter-substrate interface, the cutting table having a plurality of radial ridge sets, each radial ridge set comprising a plurality of ridges radially extending from a periphery of the cutting table toward the cutter axis, with a ridge spacing between adjacent ridges in each ridge set and a set spacing at the periphery between adjacent radial ridge sets, wherein the set spacing is greater than the ridge spacing, wherein the cutting table has a total of three or four of the radial ridge sets.

18. A drilling method, comprising:

rotating a drill bit about a bit axis, the drill bit comprising a bit body with one or more blades each having one or more cutter pockets and one or more shaped cutters secured in a respective one of the cutter pockets, each shaped cutter comprising a substrate having a proximal end and a distal end and defining a cutter axis passing through the proximal and distal ends, and a cutting table secured to the proximal end of the substrate at a cutter-substrate interface, the cutting table having a cutting end comprising a plurality of radial ridge sets, each ridge set comprising a plurality of ridges radially extending from a periphery of the cutting table toward the cutter axis, with a ridge spacing between adjacent ridges in each ridge set and a set spacing at the periphery between adjacent radial ridge sets, wherein the set spacing is greater than the ridge spacing, wherein the cutting table has a total of three or four of the radial ridge sets; and axially engaging a formation to be drilled with the drill bit while rotating the drill bit.

* * * * *